United States Patent [19]

Barone et al.

[11] Patent Number: 4,787,110

[45] Date of Patent: Nov. 29, 1988

[54] FOAMING TESTING APPARATUS WHICH YIELDS RESULTS CORRELATABLE TO HAND WASHING OF LAUNDRY

[75] Inventors: Patrizia Barone, Piscataway; Pallassana Ramachandran, Robbinsville, both of N.J.

[73] Assignee: Colgate-Palmolive Company, New York, N.Y.

[21] Appl. No.: 72,469

[22] Filed: Jul. 13, 1987

Related U.S. Application Data

[63] Continuation of Ser. No. 836,907, Mar. 6, 1986, abandoned.

[51] Int. Cl.[4] ..... D06B 23/00

[52] U.S. Cl. ..... 8/158; 8/159; 68/132; 73/60.1

[58] Field of Search ..... 68/132, DIG. 1; 73/60.1; 366/243, 270; 8/158, 159

[56] References Cited

U.S. PATENT DOCUMENTS

| | | | |
|---|---|---|---|
| 431,821 | 7/1890 | Persanowsky | 366/276 X |
| 1,541,371 | 6/1925 | Merrill | 68/DIG. 1 |
| 2,139,501 | 12/1938 | Jackson | 68/132 |
| 2,315,983 | 4/1943 | Ross et al. | 73/60.1 |
| 2,380,679 | 7/1945 | Smith | 73/60.1 |
| 2,968,172 | 1/1961 | Johnson | 73/60.1 |

FOREIGN PATENT DOCUMENTS

| | | | |
|---|---|---|---|
| 2551260 | 5/1977 | Fed. Rep. of Germany | 73/60.1 |

*Primary Examiner*—Harvey C. Hornsby
*Assistant Examiner*—Frankie L. Stinson
*Attorney, Agent, or Firm*—Murray M. Grill; Norman Blumenkopf

[57] ABSTRACT

Detergent laundry bars of improved foaming properties during hand washing of laundry are described which include 15 to 45% of a mixture of 0.05 to 20 parts of sodium higher fatty alcohol sulfate and 1 part of sodium alpha-sulfo-higher fatty acid lower alkyl ester, 10 to 60% of a builder for the detergent mixture, a bodying proportion, in the range of 20 to 70%, of water insoluble powder and/or sodium sulfate filler, and 5 to 22% of water (including that which is removable from any hydrate components when the bar is subjected to heating at 105° C. for two hours). Preferably the invented bars will comprise 5 to 20% of sodium coco alcohol sulfate, 10 to 20% of sodium alpha-sulfo-higher fatty acid methyl ester, 8 to 20% of sodium tripolyphosphate, 5 to 15% of sodium carbonate, 1 to 6% of sodium silicate, 20 to 35% of calcium carbonate powder, 0 to 15% of talc and 7 to 11% of water. The described bars, which are preferably milled and plodded, exhibit better foaming properties in use, with initial foaming, persistence of foaming and regeneration of foam when the wash water is re-used (especially regeneration foaming) being greater than those of comparable bars in which sodium higher fatty alcohol sulfate is employed alone. The invented laundry bars are also milder to the hands and human skin than comparable bars based on sodium higher fatty alcohol sulfate as the sole anionic detergent thereof. The invented bar formula is also more easily processable during production than bars of similar formulas, but which contain either higher alcohol sulfate or alpha-sulpho-higher fatty acid methyl ester, so that the manufacturing throughput rates may be increased, power consumption may be lowered, and a more homogeneous product may be produced.

Also described are a process for manufacturing the present detergent laundry bars, a method of testing them for foaming characteristics, and a foam test apparatus.

6 Claims, 1 Drawing Sheet

Figure 1:
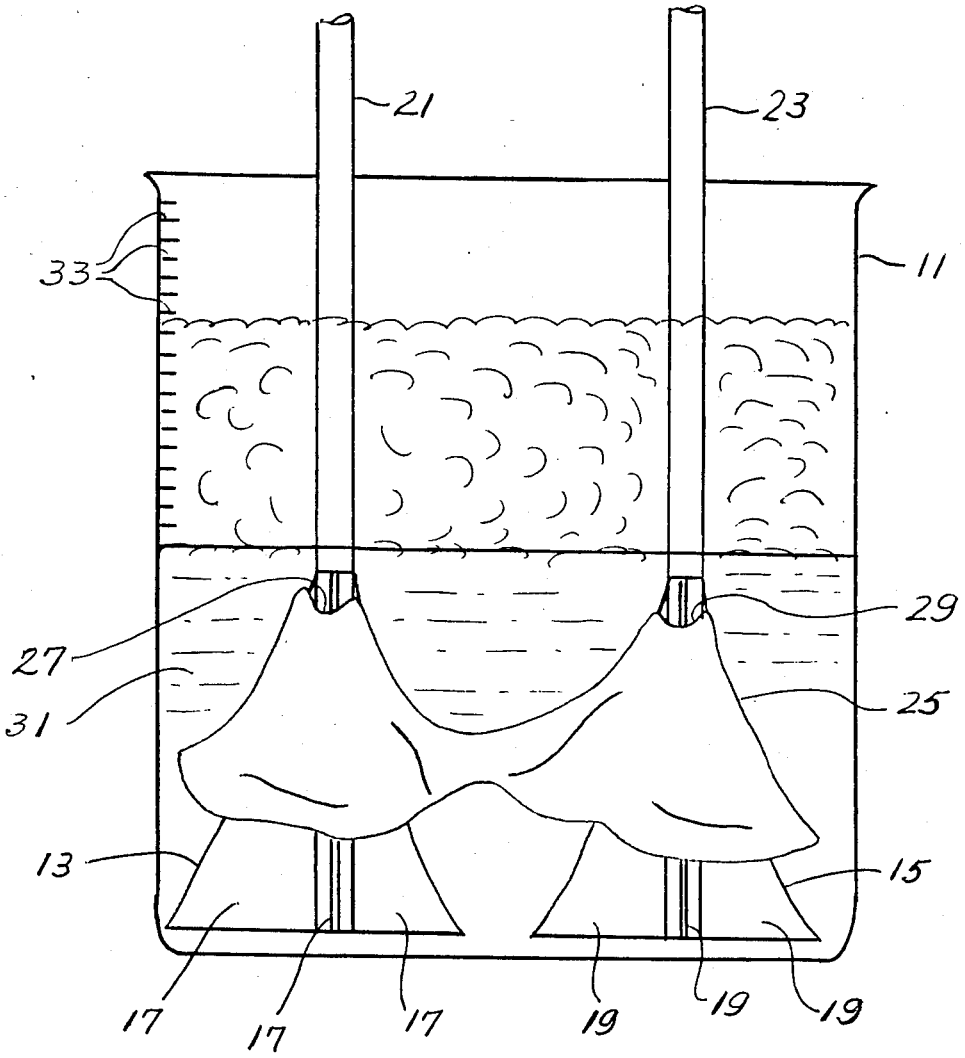

FOAMING TESTING APPARATUS WHICH YIELDS RESULTS CORRELATABLE TO HAND WASHING OF LAUNDRY

This is a continuation of application Ser. No. 836,907, filed Mar. 6, 1986, now abandoned.

This invention relates to detergent laundry bars. More particularly, it relates to a built detergent laundry bar in which the detergent comprises higher fatty alcohol sulfate and alpha-sulfo-higher fatty acid methyl ester anionic detergents. Such bars, containing such mixture of detergents, builder, bodying agent and water, are superior in various important characteristics to bars of the same formula except for the replacement of the mixture of detergents with all of one or the other. The important characteristics in which the invented bars are superior include hand wash foaming properties (initial foaming, persistence of foaming, and regeneration of foam when the wash water is re-used), mildness to the hands and human skin, and processability. Another advantage of the invented laundry bars, a least in part apparently due to the presence of the alpha-sulfo-higher fatty acid ester, is that they are not as subject to cracking, chipping, breaking or other damage on storage and handling, as are bars of the same synthetic organic detergent content in which the alpha-sulfo-higher fatty acid ester has been replaced by higher fatty alcohol sulfate. Also, the alcohol sulfate detergent helps to improve the processability and hardness of a bar that contains the alpha-sulfo-higher fatty acid ester as the sole organic detergent component. Also within the invention are a foaming testing apparatus and a process which give results that are correlatable to those obtained during hand washing of laundry with a detergent laundry bar.

Soap bars have long been employed for washing the human body and for "doing laundry". Before the advent of washing machines dictated the employment of detersive materials in powder, disintegrable briquette or liquid forms, laundry was washed with "laundry soap" bars made from suitable soaps of higher fatty acids, such as sodium soaps of mixed tallow and rosin fatty acids. Such laundry soap bars were especially suitable for being rubbed onto badly stained or soiled portions of fabrics being laundered, as on a washboard, to deposit a high concentration of the soap on the soiled area, and they provided mechanical means for applying energy to such surfaces to assist in removing the stains and soils.

Despite the fact that after the introduction of synthetic organic detergents and washing machines the amount of soap employed for laundry use diminished greatly, soap in bar or cake form is still the personal cleaning agent of choice in most of the world, and laundry soaps and detergents in bar form are also still preferred by many consumers in various regions. Detergent laundry bars based on alkylbenzene sulfonate detergents have been successfully marketed. They have been characterized as the equivalents in washing abilities of powdered laundry detergents based on similar alkylbenzene sulfonates, and are considered by many consumers to be more convenient to use. To use them does not require the purchase of a washing machine and, as was previously indicated, the bar form of the product allows it to be used in such manner that a comparatively high concentration of detersive material may be readily applied to a heavily stained or soiled area with accompanying physical force or energy, as on a washboard, so as more readily to loosen and remove such soil or stain.

Although branched chain higher alkylbenzene sulfonate detergents, such as sodium dodecylbenzene sulfonate (the dodecyl was often highly branched propylene tetramer but could be linear too), make satisfactory detergent laundry bars, such detergents have sometimes been found to be environmentally ecologically, or economically unacceptable, and accordingly, efforts have been made to formulate detergent laundry bars, based on other synthetic organic detergents, which would be less objectionable or would be unobjectionable in such respects. Among candidates for use as such a detergent are the higher fatty alcohol (alk[en]yl) sulfates, especially the sodium salts, which are biodegradable and have been successfully employed in various detergent compositions. However, such higher fatty alkyl/alkenyl sulfates had been found to be too hard, and brittle, and were susceptible to becoming damaged during handling after storage and before being used. It was observed that they appeared to change physical properties after manufacture and became prone to excessive breakage during ordinary shipment. Additionally, such products were often not as satisfactorily foaming as analogous laundry bars based on alkylbenzene sulfonate detergents. One solution to this problem is disclosed in U.S. Pat. No. 4,543,204 which teaches the incorporation of higher fatty acids in the bar formula to counteract the tendency of higher fatty alcohol sulfate laundry bars to crack or break during storage and shipment, and also mentions that the fatty acid improves foaming characteristics of the fatty alcohol sulfate bars. However, that requires the addition of a material to the formula which is not a detergent, or a builder, and which may be comparatively expensive. The present invention utilizes a detergent to improve laundry bar properties (foaming, processing and mildness), and results in a bar which does not crack or break to an excessive extent on storage and during shipment.

In accordance with the present invention a detergent laundry bar of improved foaming properties during hand washing of laundry comprises 15 to 45% of synthetic organic anionic detergent, which detergent is a mixture of 0.05 to 20 parts of higher fatty alcohol sulfate and 1 part of alpha-sulfo-higher fatty acid lower alkyl ester, 10 to 60% of a builder for the detergent mixture, a bodying proportion, in the range of 20 to 70%, of water insoluble powder and/or sodium sulfate filler, and 5 to 22% of water, which water includes water removable from any hydrate components of the detergent laundry bar when such bar is subjected to heating at 105° C. for two hours. Preferably the detergent laundry bar comprises 5 to 20% of sodium coco alcohol sulfate, 10 to 20% of sodium alpha-sulfo-higher fatty acid methyl ester, wherein the higher fatty alcohol is of an average of 12 to 15 carbon atoms and the higher fatty acid is a coconut, palm or palm kernel fatty acid or any mixture thereof, 5 to 30% of sodium tripolyphosphate, 5 to 25% of sodium carbonate, 0 to 8% of sodium silicate, 10 to 35% of calcium carbonate powder, 0 to 15% of talc and 5 to 15% of water. Also within the invention is a process for manufacturing a detergent laundry bar of the invention which comprises mixing together 15 to 45% of synthetic organic anionic detergent, which detergent is a mixture of 0.05 to 20 parts of sodium higher fatty alcohol sulfate and 1 part of sodium alpha-sulfo-higher fatty acid lower alkyl ester, 10 to 60% of a builder for the detergent mixture, a bodying proportion in the range of 20 to 70%, of water insoluble powder and/or sodium sulfate filler, and 5 to 25% of water, which water includes water removable from any hydrate components of the detergent laundry bar when such bar is subjected to heating at 105° C. for two hours, plodding the mixture, extruding it in bar form and cutting the bar to desired lengths.

A search of the prior art has resulted in the finding of various patents and publications which, while they refer to detergent laundry bars and to bar products containing higher fatty alcohol sulfate detergents, do not make the present invention obvious to one of skill in the art. Among these are: British patent specification Nos. 836,939; 941,988; 1,155,726; 1,191,721; and 1,191,722; U.S. Pat. Nos. 4,472,287; 4,515,707; and 4,543,204; *Detergent Age,* September 1965, pages 20, 21; and *Schimmel Briefs,* No. 364 (July, 1965). In some such disclosures the employment of sodium alkyl sulfate in detergent bars is mentioned and the disadvantages of such products are described. Detergent laundry bars based on alkylbenzene sulfonates are mentioned and various other detergents which may be employed, including alkyl sulfates, are referred to, together with adjuvants, such as higher fatty acids, higher fatty acid alkanolamides, waxes, clays, bentonite, higher fatty alcohols and higher fatty esters. However, the mentioned references do not describe, suggest or make obvious, either alone or in combination, detergent laundry bars of the present invention, that are of improved foaming, mildness and processing characteristics. Furthermore, none of such references, alone or in combination, discloses or makes obvious any combination of sodium coco alcohol sulfate, sodium alpha-sulfo-higher fatty acids lower alkyl ester, sodium tripolyphosphate, sodium carbonate, sodium silicate, calcium carbonate, talc and water in a detergent laundry bar.

The higher fatty alcohol sulfate is one in which the higher alcohol or alkyl group is normally in the range of about 10 to 18 carbon atoms. The cations will almost invariably be sodium or will include sodium, although other cations, such as triethanolamine (most preferred, after sodium), potassium, ammonium, magnesium and calcium, may also be present, usually in minor proportions, with the sodium detergent normally constituting more than 50%, preferably more than 75% and most preferably all or substantially all of the higher fatty alcohol sulfate content of the laundry bar. The higher alkyl of the higher alkyl sulfates is preferably linear and of 10 to 16 carbon atoms, more preferably 12 to 14 carbon atoms, and may be derived from coconut, palm and/or palm kernel oils, or other such oils, and may also include corresponding alkenyl compounds.

The alpha-sulfo-higher fatty acid lower alkyl esters will normally be of a higher fatty acid of 10 to 18 carbon atoms, preferably 10 to 16 carbon atoms, and more preferably 12 to 14 carbon atoms, which may be derived from the same oils as were mentioned above as sources for the production of the alcohol sulfate detergent. The lower alkyl will be of 1 to 4 carbon atoms, preferably 1 to 3 carbon atoms, and more preferably 1 or 2 carbon atoms, e.g., methyl. The cation for both detergents will normally be sodium but those cations mentioned for the alcohol sulfate can also be employed.

Other synthetic organic anionic detergents of the sulfated and/or sulfonated types (and in some cases nonionic and/or amphoteric detergents) may also be present in the laundry bar as secondary detergents but the total amounts of such secondary detergents will normally be only minor, with respect to the higher fatty alcohol sulfate and alpha-sulfo-higher fatty acid esters. Among the secondary detergents those which are preferred, especially when biodegradability is desirable, include the higher fatty alcohol ethoxylate sulfates of 1 to 20 ethoxy groups and alcohol of 10 to 18 carbon atoms, the higher fatty acid monoglyceride sulfates of 10 to 18 carbon atoms in the fatty acyl moieties, the paraffin sulfonates and the olefin sulfonates. Sometimes some branched and linear alkylbenzene sulfonates, of 10 to 18 carbon atoms in the lipophilic groups thereof, may be present, with the more biodegradable members of the alkylbenzene sulfonate class being more preferred. The higher fatty acid soaps may also be incorporated in these products, usually in minor proportions, and mixtures of the various secondary detergents with each other and/or with soaps (and/or with/of the principal higher fatty alcohol sulfate and alpha-sulfo-higher fatty acid lower alkyl ester detergents may be utilized. Higher fatty acid lower alkanolamides, such as monoethanolamides and diethanolamides, may also be included in the present detergent laundry bars but although such possess some detersive properties they will usually be employed because of their functions as improvers of other laundry bar properties (resistance to breakage, and foam quality). The various secondary detersive components of the laundry bars will normally be employed as their water soluble salts, and preferably will be sodium salts. Mixtures of different types of salts (such as were previously mentioned) may be employed, as may be mixtures of the detergents. Normally the higher fatty acyl or alkyl (or alkanol) group in the detergents will be mixtures but essentially pure starting materials may also be employed so that the detergents, whether primary or secondary detersive components of the products, may include lipophilic groups of essentially the same chain length.

Preferred higher fatty alcohol sulfates are the lauryl sulfates, and particularly, sodium lauryl sulfates, but such designation (preferred) also may apply to such detergents wherein the carbon chain length of the alcohol is not limited to 12 carbon atoms, but is primarily (over 50% and normally over 70 to 75%) of 12 to 14 carbon atoms. Such materials may be obtained from natural sources, such as coconut oil, palm oil and palm kernel oil, as may be preferred, or may be synthesized, as from petroleum products. Often it will be preferred to employ what is characterized as a broad cut of fatty alcohols covering the $C_{10-18}$ range, such as one analyzing about 0.3% of $C_{10}$, 48 to 58% of $C_{12}$, 19 to 24% of $C_{14}$, 9 to 12% of $C_{16}$, and 5 to 13% of $C_{18}$ fatty alcohols. While saturated alcohols are highly preferred as sources for the present detergent, some unsaturated alcohols, normally less than 20% of the total content, may also be present.

The higher fatty acid moieties of the alpha-sulfo-higher fatty acid lower alkyl esters may be derived from materials like those described above as sources of the higher alcohols of the alcohol sulfates.

Various water soluble builder salts, usually as sodium salts, may be incorporated in the invented laundry bars. Of these the most important are the phosphates, particularly the polyphosphates, such as sodium tripolyphosphate and sodium pyrophosphate. Sodium orthophosphate may be employed, usually in minor proportion with respect to the polyphosphate(s). Other builder salts, of the chelating or precipitating types, inorganic and organic, may also be used. Of these, typical inorganic builders are sodium carbonate, sodium silicate, normally of $Na_2O:SiO_2$ of 1:1.6 to 1:3, preferably 1:2 to 1:3, and more preferably 1:2 to 1:2.4, borax, and sodium bicarbonate. Organic builders, such as trisodium nitrilotriacetate (NTA), sodium polyacrylate, sodium citrate and sodium polyacetal carboxylate may also be used, as may be other water soluble salts of the corresponding organic acids.

In addition to the water soluble builders, some water insoluble builder may also be used, such as detergent building calcium ion exchanging zeolite, including hydrated zeolites A, X and Y, e.g., Zeolite 4A, usually containing about 20% of water of hydration. Such materials also may act as bodying agents and can improve processability but while such other desirable properties can be of some importance, herein the zeolites will be considered only as builders and will be included in the proportions specified for builders.

Different mixtures of builders may be employed to make the laundry bars of this invention but it is highly preferable that the primary builder be a partially hydrated sodium tripolyphosphate, high in type I crystal form. It has been found that such hydrated polyphosphate, which preferably is hydrated during working in with the other detergent laundry bar components, contributes substantially to the improvement of the ease of working, strength and uniform extrusion of the present laundry detergent bars. In addition to functioning as a builder, sodium silicate acts as a binder for other bar components, and helps to prevent corrosion of aluminum and other metals by the detergent bar. Sodium carbonate has bodying properties too, as does borax.

Water insoluble particulate material component of the present bars, hereafter usually referred to as bodying agents, although they may also perform other functions in the bars, contribute significantly to the formation of a firm, yet processable laundry bar, and help to regulate the release of detergent from the bar during use. While any of many insoluble materials, usually inorganic and mineral, may be employed, such as clays, talc, calcium silicate, magnesium silicate, calcium sulfate, silica, calcium phosphate, and calcium carbonate, the most important of such materials is calcium carbonate, often obtained from calcite, and talc is usually considered to be the next best such bodying agent. Talc, a natural hydrous magnesium silicate, is especially useful for promoting processing ease, improving slip and the feel of the laundry bar, helping to improve its storage characteristics and making a better foam or lather, in conjunction with the other components of the bar. Bentonite, preferably as sodium bentonite, may also be used and has the advantage of functioning as a fabric softening agent for the laundry. It may also be a processing aid.

The calcium carbonate, talc, bentonite and the other insolubles (and often other insoluble and soluble materials, too) will normally be in finely divided form, often with all or substantially all, e.g., over 99%, passing through a No. 200 sieve (U.S. Sieve Series) and sometimes preferably through a No. 325 sieve.

Instead of the mentioned insoluble bodying agents it has been found that sodium sulfate, which is water soluble, may be substituted partially or completely, preferably only partially, for up to 100% of the final insoluble bodying agent content, preferably for up to 50% thereof. It may be of particle sizes like those given in the preceding paragraph and may be mixed with the insoluble bodying agents.

Fatty acids of 10 to 18 carbon atoms, preferably primarily of 12 to 14 carbon atoms, e.g., coco fatty acids, may be used to improve the resiliency of the present bars, to prevent breakage thereof on storage and during shipment, as described in U.S. Pat. No. 4,543,204, but it is a feature of this invention that such are not required.

Various adjuvants may be employed in the present detergent laundry bars for their individual desirable effects. Among such adjuvants are: foam stabilizers, such as higher fatty acid lower alkanolamides, e.g., lauric myristic diethanolamide; binders, such as starches and modified starches; plasticizers, such as higher fatty alcohols, e.g., cetyl alcohol, lauryl alcohol; colorants, such as dyes and pigments, e.g., Polar Brilliant Blue dye and ultramarine blue pigment; fluorescent brighteners, such as stilbene brighteners; whitening agents, such as titanium dioxide (anatase); antioxidants, e.g., benzohydroxytoluene; perfumes; anti-redeposition agents, e.g., sodium carboxymethylcellulose (which also may have binding properties); enzymes, e.g., protease, amylase; bactericides; fungicides; and solvents.

In addition to the above components water will be present in the laundry bar. While it is preferred to employ deionized water, tap water or city water may be utilized, preferably with the hardness content thereof being no more than 200 parts per million, as calcium carbonate, and more preferably with such hardness being less than 100 or 50 p.p.m. The water serves as a mutual solvent and plasticizing agent for various components of the detergent bar and facilitates hydration of some of the hydratable materials, such as sodium polyphosphate, sodium pyrophosphate, sodium carbonate, sodium sulfate, bentonite and starch (when present). In conjunction with detergents, binders, bodying agents and/or hydratable salts present, plus some adjuvants, the water tends to facilitate processing, such as milling and plodding, and helps to maintain the detergent bar sufficiently strong so that it will resist cracking and breakage on shipment after manufacture and storage. It appears that if any of the higher fatty acids are present they may inhibit evaporation of moisture from the laundry bar, thereby helping to keep the bar in stronger more hydrated condition on storage. They also act as lubricants an plasticizers in the bar. The alkanolamide and higher fatty alcohol, if present, may also have such effects.

The proportions of the various components in the final detergents are approximately the same as those in the mixture of materials being formulated (usually in an amalgamator) for milling and plodding because relatively little moisture is lost in such operations. Normally the moisture loss will be between 0.5 to 3%, and most of the time the loss will be between 1 and 2%, e.g., 1.5%. If it appears during the mixing or subsequent operations that the composition is insufficiently plasticized due to low water content, additional water may be employed, which is usually added to the amalgamator, sigma-type mixer or other suitable mixing or blending device, with the various other components of the laundry bar.

The final bar will have a total content of the higher fatty alcohol sulfate and alpha-sulfo-higher fatty acid lower alkyl ester which will be in the range of 15 to 45%, preferably 20 to 35%, and more preferably 25 to 31%, e.g., 28%.

The proportion of the alcohol sulfate to the alpha-sulfo-fatty acid ester will normally be in the range of 0.05 to 20 parts of alcohol sulfate to 1 part of alpha-sulfo ester, preferably 0.2 to 4 parts to 1, and more preferably 0.5 to 1.5 parts to 1, e.g., 0.75 part to 1. Usually no other detergent will be present but sometimes up to 5 or 10% of an auxiliary detergent may be employed, such as a sodium higher fatty alcohol ethoxylate sulfate, e.g., Neodol 25-3S, which may or may not be in replacement of some (usually less than half) of the fatty alcohol sulfate.

The percentage of sodium higher fatty alcohol sulfate in the laundry bar will preferably be in the range of 2 to 30%, more preferably 5 to 20%, and often still more preferably about 10% to 15%, and the corresponding percentages of sodium alpha-sulfo-higher fatty acid lower alkyl ester should usually be 2 to 30%, 10 to 20% and 12 to 18%, respectively. The builder content will normally be in the range of 10 to 60%, preferably 20 to 40% and sometimes more preferably about 22% or 26%, and it will often be preferred that the builder be inorganic water soluble salt, such as a mixture of sodium tripolyphosphate, sodium carbonate and sodium silicate ($Na_2O:SiO_2=1:2.4$). The percentage of bodying agent present will normally be in the range of 20 to 70%, preferably 25 to 50% and often more preferably 25 to 45%. The ranges of percentages of water in the bar, which includes water removable from any hydrate components when the bar is subjected to heating at 105° C. for two hours, following a normal moisture analysis procedure, will normally be 5 to 22%, preferably 5 to 15%, more preferably 6 to 12%, and sometimes most preferably 7 to 11%, e.g., about 10%. With respect to individual builders and bodying agents it may be preferred that the builders include 5 to 25% of sodium tripolyphosphate, 0 to 25% of sodium carbonate and 0 to 10% of sodium silicate, more preferably 8 to 20%, 5 to 15%, and 1 to 6%, respectively, e.g., about 12% of sodium tripolyphosphate, about 10% of sodium carbonate and about 2% of sodium silicate. The bodying agent, preferably water insoluble powder, will preferably comprise 20 to 35% of calcium carbonate and 0 to 15%, or 5 to 15% of talc, more preferably about 26% of calcium carbonate and about 11% of talc.

Adjuvant content will usually be limited to 5% and preferably will be limited to 3%. Thus, the proportion of adjuvants present may be in the range of 0.5 to 3 or 0.5 to 5%, e.g., about 1 or 2%, and individual adjuvant percentages will usually be in the 0.1 to 1% range.

The invented detergent laundry bars can be processed with available equipment of types used for manufacturing soap and detergent bar products. Initially, a heavy duty amalgamator or mixer, such as one equipped with sigma-type blades or one equipped with counter-rotating paddle type agitators, is used to mix the various components, most of which are powdered but some of which may be in liquid state, sometimes as aqueous solutions. The order of addition of the various components of the laundry bars is not considered to be important so long as reasonable care is taken to prevent complete or premature hydration of the phosphate (and any other hydratable components which desirably hydrate during working of the composition), and to prevent any excessive lumping or concretion which could occur in the mixing process. The mixing may take only a short time, but can take from one minute to an hour, with the usual mixing time being from 2 to 15 minutes. The mixed product will desirably be in separable solid form at about room temperature and will be charged, preferably by means of a multi-worm transfer conveyor (preferably equipped with cooling means), to a multi-rolled mill, such as a five-roll Lehmann mill of the soap mill type. The mill will be equipped with means for heating or cooling and normally the cooling means will be employed to maintain the ribbon temperature from the mill within the range of about 30° to 40° or 45° C. Various ribbon and chip thicknesses may be employed but usually such thicknesses will be in the range of 0.1 to 1 mm., preferably 0.2 to 0.4 or 0.5 mm. However, other thicknesses may be made, depending on particular formulations being milled, so long as the composition is satisfactorily homogenized on the mill and providing that any coarse particles that may be present are pulverized so that the finished product is not objectionably gritty.

The milled chips, or milled materials, in other form, are then conveyed to a double stage vacuum plodder, operating at a high vacuum e.g., 600 to 740 millimeters of mercury vacuum, in which any entrapped air is evacuated. The mass of laundry detergent composition is worked in the plodder and is extruded from it as a bar. The plodder is equipped with a heated nozzle which softens the composition immediately prior to extrusion, allowing the production of a uniform and homogeneous bar. Such bar may be cut to length and impressed with a product brand name by means of a combination of rotary cutter and imprinter, or it may be cut to lengths, called blanks, and may be stamped to shape in a press. Before pressing, the blanks may be cooled in a cooling tunnel. If not to be pressed, the cut lengths are cooled before wrapping. In either case the cooled bars are automatically wrapped, cased and sent to storage, prior to shipping.

The previous description is one for the manufacture of the laundry detergent bars of this invention when the anionic detergents are added to the mixer in powder, flake or paste form. However, one or more of such detergents, may also be formed in situ by neutralizing the appropriate corresponding detergent acid(s) with soda ash or other suitable neutralizing agent, when that is feasible. Such a reaction may result in the production of sodium sulfate from any excess sulfuric acid present or if excess soda ash is employed sodium carbonate may result. Unreacted higher fatty alcohol may also be present with the detergent. All such materials are useful components of the present laundry bars. The described neutralization reaction may be effected in a separate reactor but may also be conducted in the mixer to be employed for mixing the other laundry bar constituents with the anionic detergents.

The detergent laundry bars made in accordance with this invention have properties superior to those of detergent laundry bars based solely on either the higher fatty alcohol sulfate or the alpha-sulfo-fatty acid ester, as was previously mentioned. It appears that this result is obtained because various components of the laundry bars interact and contribute toward the final desirable properties of the product in several ways. The result is that an improved synthetic organic detergent laundry bar has now been made which includes higher fatty alcohol sulfate but is of better foaming, processing, mildness and storage properties than previous higher fatty alcohol sulfate bars. It is also superior to bars made of the same general formula but with alpha-sulfo-fatty acid ester as the sole synthetic organic detergent component.

The following examples are given to illustrate the invention but are not to be considered as limiting it. Unless otherwise indicated all temperatures are in °C. and all parts and proportions are by weight.

EXAMPLE 1

| Component | Percent |
|---|---|
| Sodium coco fatty alcohol sulfate | 12.0 |
| Sodium alpha-sulfo-$C_{12-14}$-higher fatty acid methyl ester | 16.0 |
| Sodium tripolyphosphate (high in Phase I content) | 12.0 |
| Sodium carbonate, anhydrous | 10.0 |
| Sodium silicate ($Na_2O:SiO_2$ = 1:2.4) | 2.0 |
| Calcium carbonate, powdered (through No. 200 sieve, U.S. Sieve Series) | 26.2 |
| Talc, powdered (through No. 200 sieve, U.S. Sieve Series) | 11.0 |
| Sodium carboxymethyl cellulose | 0.5 |
| Pigment, white (titanium dioxide, finely powdered) | 0.3 |
| Optical brightener (stilbene type) | 0.2 |
| Perfume | 0.3 |
| Water | 11.0 |
| | 101.5 |
| water loss in processing | 1.5 |
| | 100.0 |

A detergent laundry bar of essentially the formula given (with 1.5% extra water to compensate for that lose in mixing, milling and plodding) is made by a process which includes the steps of mixing, milling, plodding, cutting to lengths and (optionally) pressing to shape. Mixing is effected in a conventional soap or detergent amalgamator or mixer having a sigma-type mixing blade. The order of addition of the components is not critical but the sodium tripolyphosphate, which is hydratable, will preferably be added at such a time as to promote uniformity of hydration of the polyphosphate, while it is in homogeneous contact with other bar components, which helps to strengthen the final bar. In the mixing operation described, various other powder components of the formula are first added to the mixer, followed by the sodium cocoalkyl sulfate and sodium alpha-sulfo-higher fatty acid methyl ester in powder or flake form, and the liquid components. The liquids can also be added earlier providing that desirably uniform partial hydration of the polyphosphate is obtained. Mixing takes only a brief time, about five minutes, which is intentional so as to inhibit complete hydration of the polyphosphate. The contents of the mixer are fed by a multi-worm conveyor to a five-roll mill of the Lehmann type, wherein the mix is converted to ribbon and chip form. The multi-worm transfer conveyor is equipped with cooling means so as to prevent excessive sticking of the mixture to the conveyor parts.

The mill, which is also equipped with cooling means, operates at such a temperature that the final chip is at a suitable temperature, in the range of about 35° to 42° C., but in some instances higher or lower temperatures may be employed. The chip thickness is maintained in the range of 0.2 to 0.4 mm. The milled chips are then fed to a double stage vacuum plodder, which operates at a vacuum of about 700 mm. of mercury, to remove any entrapped air and to work the composition and extrude it as a bar through a heated nozzle, wherein the composition is heated sufficiently to facilitate extrusion as a homogeneous bar. The bar is then cooled to a suitable pressing temperature, preferably in the range of 20° to 30° C., e.g., 25° C., and is pressed to final bar or cake shape, following which it is automatically wrapped, cased and sent to storage. Alternatively, instead of being pressed to shape, the bars may be cut or essentially simultaneously cut and impressed with a company name or other indicia, in which case the mentioned cooling may be effected after cutting and/or impressing.

The milling and plodding proceed well, with power requirements being substantially like those for manufacturing soap bars, and the bars made appear to be homogeneous. The bars are evaluated by expert evaluators and by consumers and are found to be of satisfactory utilitarian and aesthetic characteristics. Particularly, the bars are found to foam, persist in foam and refoam satisfactorily, to feel good to the hands of the user, to clean well, to be sufficiently hard, and not to be consumed too quickly. Also, it is noted that the invented bars that are subjected to handling like that normally encountered in commercial distribution do not crack, break, powder or disintegrate so as to be unsatisfactory, whereas prior detergent laundry bars based on higher fatty alcohol sulfate alone as the synthetic organic detergent component, did not possess sufficient resistance to breakage during storage and transportation, so as to be commercially acceptable.

The foaming tests run to evaluate the invented bars (and controls, which will be discussed later) accurately reflect actual use conditions of the present laundry bars. In actual use the items to be washed are wet and then are rubbed, on a washboard, with the laundry bar. After rubbing enough detergent composition into the item to be cleaned the item is rubbed on the washboard or other hard surface until any dirt, soil or stain is removed. It is then rinsed and sometimes is re-treated. The washboard may be in a sink, pail or other suitable container which will hold wash water in the bottom part thereof. After washing the first item of laundry, additional items of laundry may be wet in the wash water and then rubbed on the washboard, sometimes with and sometimes without the application of additional detergent composition from the laundry bar. It is important to the consumer that in this second and subsequent washings the wash water will still generate foam, as the laundry is moved through it during the process of rubbing it on the washboard.

In a test devised to yield data corresponding to that from such hand washing processes, a pair of oscillating washing machine-type agitators, on a reduced scale, is employed, with a piece of toweling located atop them near the bottom thereof, so that as the agitators move in a container of wash water, the toweling twists and untwists, creating a unique simulation of movement o laundry through the wash water. To start the test 2.5 g./l. solutions of representative shavings from laundry bars in hard water (300 p.p.m., as $CaCO_3$) are made by dissolving (it is recognized that insoluble components disperse) bar pieces in water, and the foam heights are measured after five minutes agitation. The agitators are then turned off and the wash water and foam are allowed to rest for two minutes, after which the foam height is again measured. The agitators are turned back on and the foam height is measured after another five minutes agitation (reagitation). By such tests the initial foam height of the invented formula is 40 mm. After two minutes standing it is still 40 mm. and after reagitation it is increased to 70 mm.

A control or comparison product is made of the same formula as given above except for the replacement of the sodium alpha-sulfo-higher fatty acid methyl ester with sodium coco fatty alcohol sulfate. The processing is the same as for the invented composition of this example but is more difficult, and significantly more electrical power is required to operate both the mill and the plodder. Also, the bar made does not appear to be as homogeneous, and it is found to crack and break on storage and during transportation. Both in actual hand laundering tests and by laboratory tests, such as that previously described, the control bar is found to be inferior to the invented bar in foaming and is considered to be poorer in cleaning. The foam heights, by the tests previously described, are 30 mm., 30 mm. and 40 mm., respectively. Thus, the invented formula is significantly better in foaming volume, especially reagitation foaming volume, and the foam is desirably rich and creamy looking, not thin and lace-like in appearance.

A second control bar is made of the present formula except for the replacement of the sodium coco fatty alcohol sulfate with the sodium alpha-sulfo-$C_{12-14}$-fatty acid methyl ester and is tested for foaming characteristics by the method described above, which is known as the Colgate-Ram test. The results are foam heights of 30, 10, and 40 mm., respectively. The initial foaming height of this "control" is lower than that of the invented bar of the given formula, the foam height after rest is almost nil, and the foam height after reagitation is significantly less than for the invented bar.

The apparatus employed for the foam test is illustrated in the drawing, in which:

FIG. 1 is an elevation view of the apparatus, containing wash water and foam produced.

Container 11, a glass beaker, as illustrated, has agitators 13 and 15 positioned therein, with the bottoms of the agitators near the bottom of the beaker. The agitators are equipped with flared vanes 17 and 19. Three are visible for each agitator. The molded vanes are integral with shafts, 21 and 23, respectively, which are fastened to oscillating means, not shown, at the tops thereof. A cloth, such as a nubby fabric facecloth 25, has openings therein, the walls of which are indicated by numerals 27 and 29, and the facecloth is positioned so that the openings fit over the shafts 21 and 23, respectively and the cloth rests on agitator vanes 17 and 19.

During testing, the container 11 is partially filled with hard water 31, to which a test proportion of the detergent bar being tested (in powdered form) is added. The container includes graduations 33 to indicate the height to which the foam generated during the operation of the apparatus rises, and at which it remains. During the test the agitators are moved in counter-rotating oscillating movement so that the facecloth 25 is twisted while at the same time the agitators are agitating the wash water. The combined movements simulate the agitation produced when laundry is hand washed and it has been found that the test results, in which foaming characteristics of different bar formulations are compared, are accurately related to such foaming properties of the bars during actual hand washing operations.

EXAMPLE 2

The experiment of Example 1 is repeated, using a formula like that given in such example except for an increase in the sodium coco fatty alcohol sulfate content from 12 to 16% and a decrease in the sodium alpha-sulfo-$C_{22-14}$ fatty acids methyl ester content from 16 to 12%. The composition processes well, significantly better than the control composition containing 28% of sodium coco fatty alcohol sulfate, with the power requirements being significantly less for the composition of this example. The bars made are desirably hard and smooth and foam almost as well as those of the formula of Example 1. Thus, with respect to foaming characteristics, as indicated by the described test, the initial foam was 40 mm., after two minutes standing it was 40 mm., and after reagitation it was 60 mm. The described bars of this example are of the desirable characteristics of the bars of the composition of Example 1 and are superior to the all-alcohol sulfate composition in foam and in mildness to the hands, and apparently also in cleaning power.

EXAMPLE 3

When other compositions within the invention are made, of the same formulas as those of Examples 1 and 2 except for the employment of other proportions of higher fatty alcohol sulfate and-alpha-sulfo-fatty acid methyl ester, of proportions within the 5 to 20% and 10 to 25% ranges, with the ratio of said sulfate to said ester being in the range of 0.2 to 4 parts of sulfate to 1 part of ester, e.g., 8% and 20%; and 14% and 14%; and 21% and 7%, improved foamings compared to the 28% "pure" alcohol sulfate and 28% "pure" alpha-sulfo fatty acid ester controls are obtainable. However, when proportions of alcohol sulfate and alpha-sulfo ester outside the ranges given in this specification are employed in similar formulas, the foaming heights or volumes are not better than for 28% alcohol sulfate formula.

For all the invented compositions of this example and Examples 1 and 2 the foams obtained are desirably thick and attractive, being superior in this respect to the thinner, more "lacy" foams of compositions based on alkylbenzene sulfonate detergents. Such results are also obtainable when instead of sodium alpha-sulfo-coco fatty acid methyl ester, the triethanolamine or potassium salt is employed, the ester is one of a lower alcohol, preferably of 1 to 3 carbon atoms, e.g., ethanol; and when the higher fatty alcohol sulfate is of tallow alcohol, cetyl alcohol or dodecanol, and the cation thereof is lower alkanolamine, potassium or other which is water soluble salt-forming. Instead of using coco alcohols for making the detergents one may substitute palm alcohols or palm kernel alcohols or equivalent natural based materials, and similar results may be obtained.

In the testing of the products for foam characteristics the wash water may be of a hardness of 100 to 400 p.p.m., as $CaCO_3$, preferably about 300 p.p.m., the detergent bar concentration may be 1 to 5 g./l., preferably about 2.5 g./l., the temperature may be 15° to 50° C., and the initial agitation period is at least three minutes, as is the subsequent agitation period, with the pause between being at least one minute.

EXAMPLE 4

When in the preceding examples, the proportions of the various components of the invented formulas are varied ±10% and ±25%, while being maintained within the ranges given in the specification, satisfactorily improved detergent laundry bars, having the previously described favorable properties, are also obtainable. Similarly, when other builders, such as sodium NTA, sodium citrate, polyacetal carboxylate and borax are employed in partial replacements, e.g., up to ½ of the sodium tripolyphosphate and sodium carbonate, preferably in replacements of equal parts of such, acceptable detergent laundry bars having the desirable properties previously mentioned are obtainable. Such is also the case when ⅓'s of each of the calcium carbonate and talc are replaced by sodium sulfate. Alternatively, bentonite, synthetic calcium silicate, pumice and tricalcium phosphate may be substituted for a part, up to ½, of the insoluble bodying agents of the previous formula. The adjuvants (CMC, pigment, brightener and perfume) may be omitted and functionally acceptable detergent bars are obtainable, but without the adjuvants' properties.

The invention has been described with respect to examples and illustrations thereof but is not to be limited to these because it is evident that one of skill in the art, with the present specification before him, will be able to utilize substitutes and equivalents without departing from the invention.

What is claimed is:

1. A method for determining comparative foaming characteristics of a detergent laundry bar, relatable to actual use of such a bar when it is employed for hand washing of laundry, which comprises dissolving/dispersing in wash water a washing concentration of a detergent laundry bar or the components thereof, subjecting the resulting wash water containing detergent laundry bar components to agitating action of at least a pair of oscillating agitators and corresponding twisting and untwisting action of textile material that is maintained in contact with the agitators, halting the movements of the agitators and the textile material, and measuring the height of foam above the wash water.

2. A method according to claim 1 wherein the agitators oscillate rotationally in a substantially horizontal plane, the textile material is face cloth material or like such material, the oscillating motions of the agitators and twistings of the face cloth material are ceased for at least one minute after the haltings of said motions, such motions are resumed, after at least three minutes they are halted, the foam height is measured, and the foam heights are compared to those of a control detergent laundry bar composition tested in the same manner

3. A method according to claim 2 wherein the wash water is at a temperature in the range of 15° to 50° C., approximating the expected temperature of actual use of the detergent laundry bar for the hand washing of laundry, the hardness of the wash water is about 300 p.p.m., as $CaCO_3$, the concentration of the detergent laundry bar components in the wash water is in the range of 1 to 5 g./l., the initial period of agitation is about five minutes, the following period of no agitation is about two minutes, and the period of reagitation is about five minutes.

4. An apparatus for determining comparative foaming characteristics of detergent laundry bars relatable to actual foaming characteristics of such bars when employed for hand washing of laundry, which comprises a container for holding wash water, at least a pair of oscillatable agitators, means for oscillating such agitators, and a textile material maintained in contact with said agitators, so that it twists and untwists as the agitators are oscillated in the wash water, simulating the movement of laundry in wash water during hand washing of the laundry.

5. An apparatus according to claim 4 wherein the oscillatable agitators are near lower ends of vertical shafts, such agitators and shafts rotate about vertical axes, and the textile material is a face cloth material with a pair of openings at opposite portions thereof, through which openings pass portions of the agitator shafts, so that such face cloths are positioned between the agitators, and above them.

6. An apparatus according to claim 5 wherein the agitators are of flared construction, larger at the bottoms thereof, and counter-rotate, and the container is transparent and has graduations on a wall thereof to indicate foam heights.

* * * * *